US007786841B2

(12) United States Patent
Kesting

(10) Patent No.: US 7,786,841 B2
(45) Date of Patent: Aug. 31, 2010

(54) FUSE CUTOUT ASSEMBLY

(76) Inventor: John Kesting, 102 Golda Heard, Dawsonville, GA (US) 30534

( * ) Notice: Subject to any disclaimer, the term of this patent is extended or adjusted under 35 U.S.C. 154(b) by 192 days.

(21) Appl. No.: 11/968,149

(22) Filed: Dec. 31, 2007

(65) Prior Publication Data

US 2009/0167479 A1 Jul. 2, 2009

(51) Int. Cl.
*H01H 85/60* (2006.01)
*H01H 85/54* (2006.01)

(52) U.S. Cl. ..... 337/180; 337/168; 337/170; 337/171; 337/172

(58) Field of Classification Search ..... 337/168, 337/180, 170–172
See application file for complete search history.

(56) References Cited

U.S. PATENT DOCUMENTS

| | | | | | |
|---|---|---|---|---|---|
| 2,263,513 | A | * | 11/1941 | Meyer | 337/190 |
| 2,331,847 | A | | 10/1943 | Schultz | |
| 2,357,772 | A | * | 9/1944 | Schultz | 337/173 |
| RE22,747 | E | * | 4/1946 | Schultz et al. | 337/156 |
| 2,745,923 | A | * | 5/1956 | Lindell | 337/223 |
| 2,798,133 | A | * | 7/1957 | Curtis | 337/177 |
| 2,834,856 | A | * | 5/1958 | Charewicz et al. | 218/43 |
| 2,840,668 | A | * | 6/1958 | Yonkers | 337/250 |
| 2,910,560 | A | * | 10/1959 | Stroup et al. | 337/174 |
| 3,005,891 | A | * | 10/1961 | Charewicz et al. | 337/156 |
| 4,326,184 | A | * | 4/1982 | Murdock | 337/168 |
| 4,414,527 | A | * | 11/1983 | Biller | 337/180 |
| 4,774,488 | A | * | 9/1988 | Field | 337/171 |
| 4,945,333 | A | * | 7/1990 | Stroud et al. | 337/176 |
| 5,191,311 | A | * | 3/1993 | Webb et al. | 337/168 |
| 5,532,668 | A | * | 7/1996 | Fennell | 337/168 |
| 5,670,927 | A | * | 9/1997 | Fennell | 337/168 |
| 5,742,220 | A | * | 4/1998 | Scherer | 337/171 |
| 6,392,526 | B1 | * | 5/2002 | Roberts et al. | 337/178 |
| 6,462,639 | B1 | * | 10/2002 | Farag et al. | 337/172 |
| 6,512,442 | B1 | * | 1/2003 | Taylor | 337/171 |
| 6,583,708 | B1 | * | 6/2003 | Smith et al. | 337/169 |

* cited by examiner

*Primary Examiner*—Anatoly Vortman
(74) *Attorney, Agent, or Firm*—Alfred F. Hoyte, Jr.

(57) ABSTRACT

A fuse cutout assembly having enhanced safety features to aid in both removal and replacement of fuse tubes. The inventive assembly can be produced by making modifications to standard fuse cutout assemblies. The modifications include lengthening the trunnions of the lower contact assembly and adding reflectors as a further visual aid for positioning the lower contact portion of the fuse tube within the trunnion sockets. Additionally, a molded plastic guide placed proximate the lower contact area of the fuseholder of the cutout promotes "self guiding" of the fuseholder during replacement. Also, the pull ring is modified by the addition of protruding arcuate sections extending from a standard pull ring, the sections allowing the technician to engage the pull down ring without aiming the hook stick through the ring. Additional reflectors are strategically placed to facilitate replacement of the fuseholder.

12 Claims, 3 Drawing Sheets

FUSE CUTOUT ASSEMBLY

BACKGROUND OF THE INVENTION

1. Field of the Invention

The present invention concerns fuse cutout assemblies. More particularly, the invention is directed to an improved cutout assembly having means to aid in removal and replacement of a fuse tube.

2. Description of the Prior Art

Fuse cutout assemblies having removable fuse tubes have been in use for many years. The devices are generally characterized by the provision of an insulator mounted on a bracket having spaced contact assemblies. A lower contact assembly has a pair of spaced opposing trunnion sockets formed therein, while an upper contact assembly has a integral latching member, usually spring loaded. A fuseholder of the assembly has a lower end with opposing contact ears or trunnions that are adapted for insertion in journaled relation within the trunnion sockets. The upper end of the fuse tube has a latching contact end shaped for engagement with the upper contact assembly of the bracket. The fuseholder is thus removably positioned both physically and electrically in parallel with the insulator.

Servicing these cutout assemblies, e.g., replacing the fuse, is generally accomplished by engaging the operating end of an extended hook stick within a pull ring provided proximate the upper contact assembly and corresponding latch. The worker then pulls down on the ring disengaging the latch and allowing the fuse tube to be accessed. Once the service/repairs are complete, the worker again engages the hook stick with the ring and rotates the fuseholder upwardly until the latch is engaged. A common problem encountered by utility company workers when servicing these cutout assemblies is that the fuse tube and its switch contact assemblies become disengaged from the bracket and fall to the ground putting the workers and equipment at risk. When the weather is inclement, as is typically the case, the risk of the fuse tube falling is particularly great. Also, servicing must be done at night or when visibility is otherwise low, causing great difficulty to the worker attempting to engage a relatively small ring with a hook stick from as much as 40 feet away. Regardless of how large the ring is made, the worker must still visually verify engagement of the hook stick therewith, and this can be an extremely time consuming operation. Furthermore, when replacing the fuseholder of the assembly, visual alignment of the fuseholder to ensure that the trunnions are properly positioned relative to the trunnion sockets is difficult, and improper alignment virtually guarantees that the fuseholder will fall, with the attendant risk of injury. Accordingly, many modifications have been made to the "standard" cutout assembly to reduce the risk of the fuseholder falling, both when engaging and disengaging the fuse tube. The modifications are typically fairly complex and are of limited effectiveness. Furthermore, most modifications that are considered "safety features" are often bypassed as they tend to make the service even more tedious, while only providing a limited safety factor. Finally, some manufacturers propose cutout assemblies radically different from standard assemblies, which have the drawback that technicians are totally unfamiliar with them and are unlikely to be proficient when servicing them.

U.S. Pat. No. 5,670,927 issued to Fennell discloses a fuse holder with built in safety features. In lieu of a ring, the device has a slot within which the operation end of the hook stick may be placed to effect removal of the fuse tube. The problem with the Fennell device is that the slot is fashioned on the lower end of the fuse tube limiting the amount of torque that can be generated. Also, Fennell contemplates doing away with the ring entirely, not merely modifying it.

U.S. Pat. No. 2,331,847 issued to Schultz discloses a fuse device having a pull ring with an enlarged, substantially right triangular shape. Also, Schultz discloses the provision of a pair of annular flanges to assist in positioning the trunnions within the trunnion sockets. Again, Schultz contemplates replacing and not modifying the traditional cutout assembly. Also, the flanges add additional bulk to the lower contact end of the assembly, possibly increasing the difficulty of replacing the fuse.

The present invention is directed to a fuse cutout assembly having enhanced safety features to aid in both removal and replacement of fuse tubes. The inventive assembly can be produced by making modifications to standard fuse cutout assemblies. The modifications include lengthening the trunnions of the lower contact assembly and adding reflectors as a further visual aid for positioning the lower contact portion of the fuse tube within the trunnion sockets. Additionally, a molded plastic guide placed proximate the lower contact area of the fuseholder of the cutout promotes "self guiding" of the fuseholder during replacement. Also, the pull ring is modified by the addition of protruding arcuate sections extending from a standard pull ring, the sections allowing the technician to engage the pull down ring without aiming the hook stick through the ring. Additional reflectors are strategically placed to facilitate replacement of the fuseholder.

SUMMARY OF THE INVENTION

It is a major object of the invention to provide a fuse cutout assembly with enhanced safety features.

It is another object of the invention to provide a fuse cutout assembly with a self aligning feature to aid in replacing the fuse portion of the assembly.

It is another object of the invention to provide a fuse cutout assembly with elongated trunnions.

It is another object of the invention to provide a fuse cutout assembly with a modified pull ring which allows disengaging the fuse tube by guiding the hook stick along the length of the fuse tube.

It is yet another object of the invention to provide a fuse cutout assembly which uses reflectors at selected positions for aligning the fuse tube during the replacement procedure.

It is another object of the invention to provide a fuse cutout assembly having means to facilitate both removing and installing replacement fuses.

Finally, it is a general goal of the invention to provide improved elements and arrangements thereof in an apparatus for the purposes described which is dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered with the accompanying drawings, in which like reference characters designate the same or similar parts throughout the several views, and wherein.

DETAILED DESCRIPTION OF THE PREFERRED EMBODIMENTS

Figure 1:
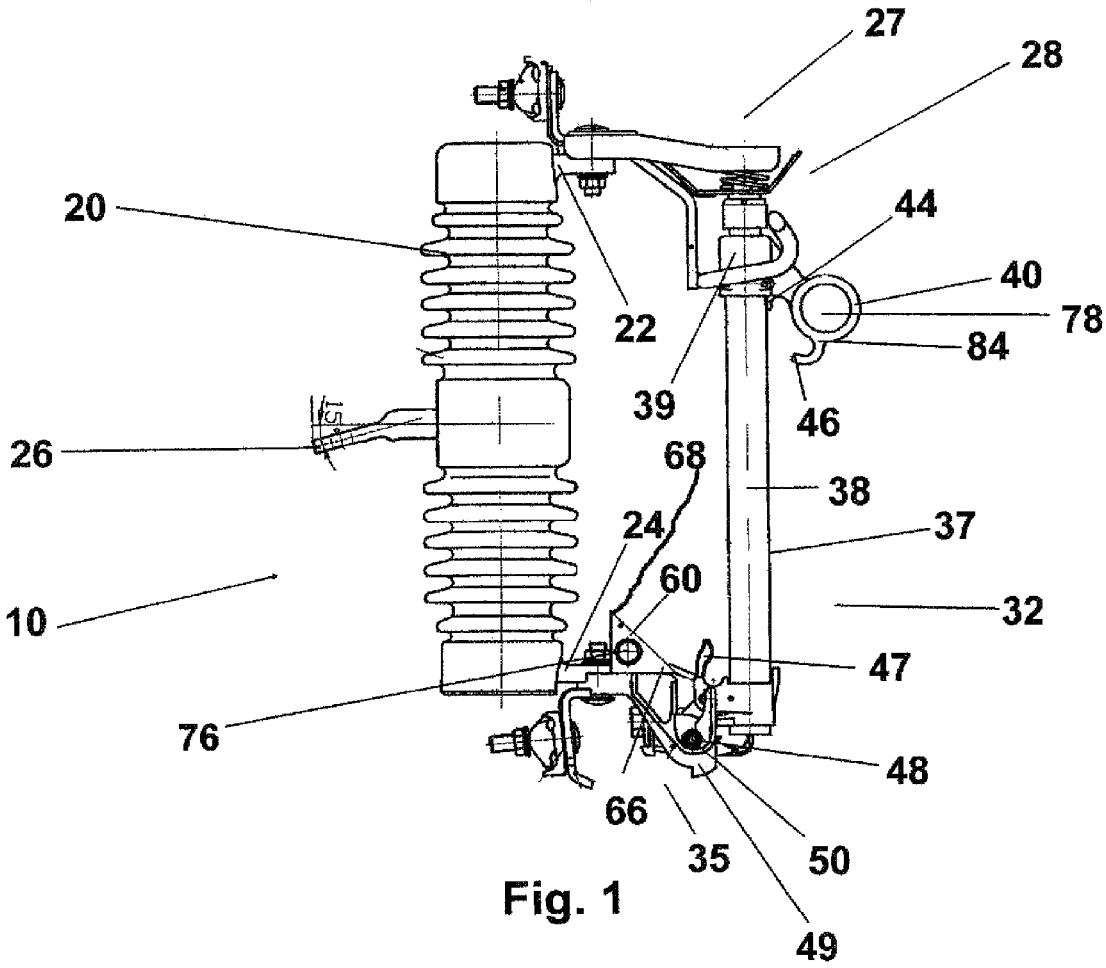
FIG. 1 shows a plan view of the fuse cutout assembly of the present invention.

Referring now to FIGS. 1-3C the fuse tube assembly of the present invention, generally indicated by the numeral 10, is shown. It can be seen that the assembly 10 is of generally standard configuration having an elongated insulator 20 from which extend, at opposing ends, stationary contact members 22, 24. The insulator 20 may be supported by a bracket 26 or the like, or by any suitable means. An upper contact assembly 27 having stationary and moving parts, the stationary part including a latching means 28 which is attached to and extends from the upper stationary contact member 22, the latching means 28 essentially a terminal adapted for removable engagement with the electrically conductive portion of the upper end 30 of the fuseholder 32 of the assembly 10, the upper end comprising the movable portion of the upper contact assembly. The latching means 28 is spring loaded and fashioned for automatically disengaging the upper end of the fuseholder 32 when the fuse melts as is well known. Any of several well known configurations may be used for this purpose, except as indicated below. Lower stationary contact member 24 is attached to lower contact assembly 35, which includes means for supporting the lower end of the fuseholder 32 of the assembly. As is customary, a double hinge support for the lower end of the fuseholder 32 is provided, which includes trunnions 48, formed of electrically conducting material, for engaging spaced jaws 49 so that the fuseholder 32 is initially mounted with the trunnions 48 arranged in the jaws 49 and is then rotated about the trunnions 48 to cause the upper end of the fuseholder 32 to become engaged with the latching means 28. Thus, the fuseholder 32 of the assembly 10 is physically and electrically connected in parallel with insulator 20 via upper and lower contact assemblies 27, 35 which assemblies include the corresponding components of the fuseholder 32.

The fuseholder 32 of the assembly 10 includes an elongated fusible link 38 contained within a fiberglass fuse barrel 37. The function of the fusible link 38 in cutout assemblies is well known and does not form a part of the present invention. A sleeve 39 attached to the upper end of the fuse barrel 37, also known as a ferrule, includes a pull ring 40 which attaches to and extends outwardly from the sleeve 39 to provide both a target and a cooperating means for the engagement of the functional end of a hook stick (not shown), the hook stick allowing a lineman to access the fusible link 38 by pulling down on the pull ring 40 with the hook stick to effectuate temporary removal of the fuseholder 32 from the cutout assembly 10. It can be seen that the ring 40 includes a pair of cooperating arcuate protrusions 44 and 46 which allow for a more facile engagement of the hook stick with the pull ring 40. Another arcuate projection 47, extending from the lower end of the fuseholder 32 allows for another tool to be employed for disengaging and removing the fuseholder 32, as will be discussed in more detail later.

When servicing fuse cutout assemblies there are two basic operations to be performed when replacing the fusible link 38 contained within the fuseholder 32. The first is removal of the fuseholder 32 to gain access to the fusible link 38, followed by replacement of the fuseholder 32 once a replacement fusible link 38 has been securely positioned. It can be appreciated that in order to ensure proper operation of the cutout assembly 10, the fuseholder 32 must be properly positioned when replaced or it will fall from the assembly 10 with the attendant risks of injury as noted above. More particularly, great care must be taken to ensure that trunnions 48, which form a part of the lower contact assembly 35 and extend from the lower end of the fuse portion 32 of the assembly, are properly seated in trunnion sockets 50 which essentially form a cradle within which the fuse portion is rotatably supported. Accordingly, many modifications made to cutout assemblies concern means for ensuring that the fuse portion 32 is properly seated so that it may be rotated upwardly to engage the upper contact assembly 27.

In one aspect of the present invention, trunnions 48 are extended laterally with respect to the fuseholder 32 to provide a larger visual target for alignment purposes. This visual aid, in accordance with a preferred embodiment, is further enhanced by the addition of reflectors 52 positioned on and secured to the forward facing portion of the outer surface of the trunnions 48. The reflectors 52 may be formed of a reflective material coated onto a flexible substrate having an adhesive on the opposing side as is well known. Due to the configuration of the trunnions 48, the reflectors are arranged in spaced relation so that the relative position and angle of the fuseholder 32 can be determined from a distance. Of course, any type of reflective material may be placed onto the trunnions 48 including hard plastic reflectors. The reflective material is preferably red or yellow or some non-metallic color so as to be easily distinguished from other metallic components of the assembly 10, but any highly reflective material may be used. As the reflective material is not electrically conductive, it must not cover the entire trunnion so as to interfere with the electrical connection of the lower contact assembly 35. The trunnions 48 are axially extended so that they protrude laterally from the outer edges of jaws 49 and trunnion sockets 50 at least an inch when placed therein so that the reflectors 52 provide a sufficiently large visual target, but any extension visually discernible from about 20 feet would be within the spirit and scope of the invention. Spring 51 coiled about shaft 53 connected between trunnions 58 is biased to urge the fuseholder 32 to the closed position as is well known.

Figure 2A:
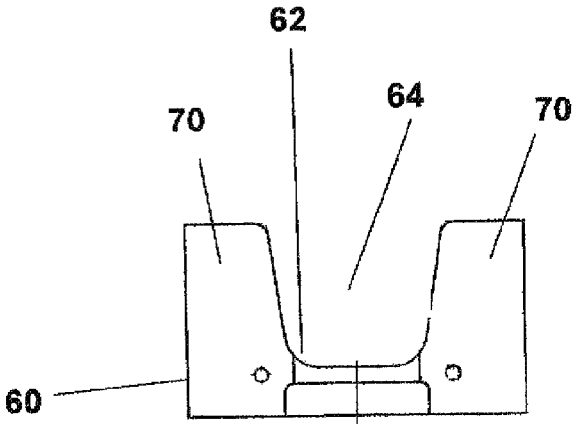
FIG. 2A shows a front view of the guide member of the fuse cutout assembly.
Figure 2B:
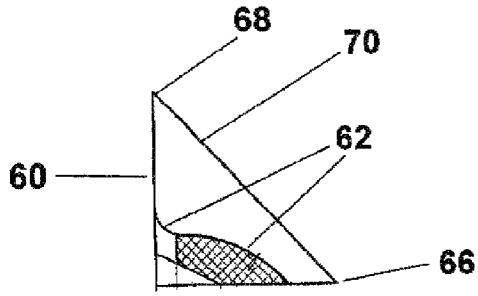
FIG. 2B shows a side view, partly in section, of the guide member of FIG. 2A.
Figure 2C:
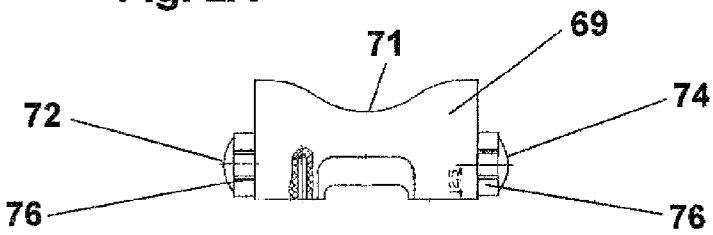
FIG. 2C shows a rear view, partly in section, of the guide member of FIG. 2A
Figure 3B:
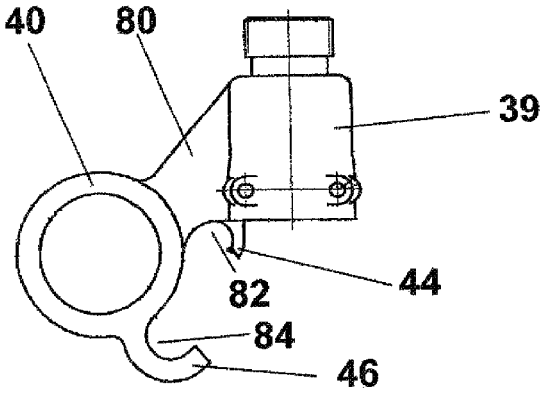
FIG. 3B is an isolated view of the pull ring portion of FIG. 3A.
Figure 3C:
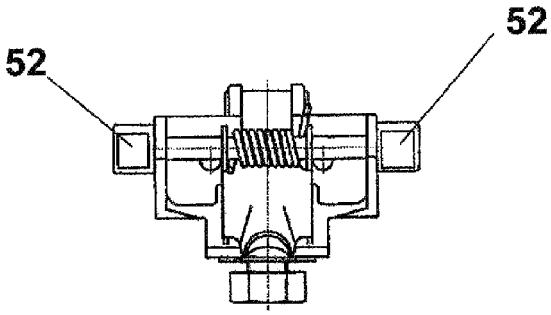
FIG. 3C is an isolated view of the spring loaded hinge and extended trunnion contacts of the fuseholder of the assembly.
Figure 3A:
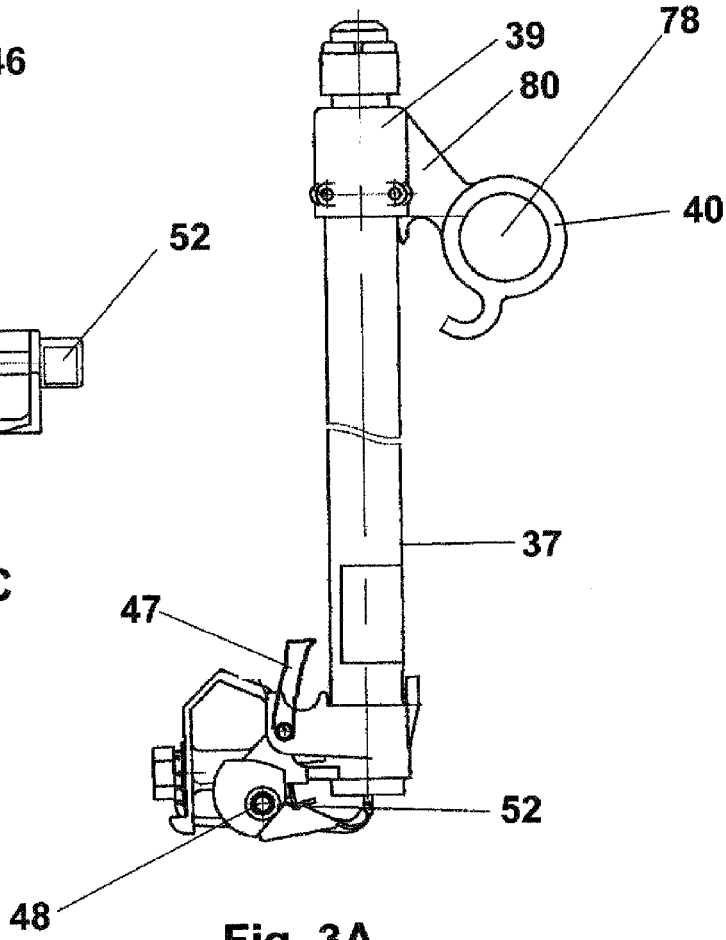
FIG. 3A shows a plan view of the fuseholder of the assembly.

Attached to the lower contact assembly 35 by a bolt or any convenient means is a slide member 60 which acts as a guide to "funnel" the lower end of the fuse portion 32, including trunnions 48 into position for re-closure of the cutout assembly 10. The slide member 60 may be formed of a single piece of hard plastic or other non-conducting material. The slide member 60 may be attached to the stationary portion of the lower contact assembly 35 with the front end 66 of the slide 60 immediately adjacent trunnion sockets 50. has a right triangular side profile as can be seen in FIG. 2B, with an interior portion defined by a contoured inner surface 62. The contoured surface 62 forms a channel 64, and the slide member 60 is graduated from front 66 to rear 68 thereby forming opposing graduated surfaces 70 on opposite sides of the channel 64. Of course, slide member may be formed with a single continuous graduated surface. The graduated surfaces 70 are sized and spaced in accordance with the size and spacing of the trunnions 48, each surface 70 effectively acting as a ramp for one of the trunnions 48. Thus, if the opposing trunnions 48 are placed anywhere along the respective inclined surfaces 70 during the replacement of the fuse portion 32, the force of gravity will tend to urge or "funnel" trunnions 48 into position within trunnion sockets 50 assuring the fuseholder 32 is properly positioned. Rear wall 69 is flat and includes an indentation 71 corresponding to the position of the channel 64. Reflectors 72, 74 positioned on bolts 76 cooperate with reflectors 52 to allow for proper centering and to ensure alignment as will be discussed below. Specifically, reflectors 72, 74 may be spaced to be slightly wider than the spacing of reflectors 52 to provide a centering target when repositioning the fuseholder 32. The spacing of the reflectors 72, 74 is a function of the width of the slide member 60, and the spacing and size of the reflectors 72, 74 should be chosen so that the reflectors 52 on trunnions 48 can be seen even when directly aligned with reflectors 72, 74. The reflectors 72, 74 may be made of hard plastic and shaped for frictional fit over the entire bolt 76. Reflectors 72, 74 must extend laterally from the slide member 60 so as to be viewable from the front of the assembly 10.

As has been previously mentioned, pull ring 40 is modified to include a pair of cooperating arcuate protrusions 44 and 46. The protrusions 44, 46 are sized to allow for engagement of the hook stick without requiring insertion of the operating end of the stick within the eye 78 of the ring 40. It can be seen that the ring 40 extends from a tab 80 with the lower inside portion of the tab having an arcuate indentation 82 extending roughly from the tab portion proximate the ring to the tip of the protrusion 44. Protrusion 46 is also curved and is extended relative to protrusion 44 from ring 40 to provide a larger arcuate indentation 84. An additional pull tab 47 is mounted onto the lower end of fuseholder 32 by a bolt or other means, the tab extending upwardly in an arched configuration and sized for engagement with a finger tool (not shown), which may optionally provide a means for removal of the fuseholder 32.

In operation, a lineman can disengage the fuseholder 32 of the cutout 10 by sliding the operating end of the hook stick up the fuse barrel 37 until it is engaged within indentation 82, This procedure does not require visual verification as the hook stick will stop traveling up the fuse barrel 37 at the point when the operation end becomes seated within the indentation 82. The lineman may then, totally by feel, slide the operating end down until it engages within indentation 84, and proceed to disengage the fuse portion by pulling down with sufficient force to effect release of latching means 28, which causes downward rotation of the fuseholder 32, which may then be removed. Once a new fusible link 38 has been replaced within the fuseholder 32, the lineman may then lower the fuse portion 32 until trunnions are seated within trunnion sockets 50. This process is enabled by positioning the lower end of the fuseholder proximate to the slide member 60, using reflectors 52, 72, and 74 to ensure centering. Specifically, centering of the fuseholder 32 can be verified by determining the point at which reflectors 52 are aligned with reflectors 72 and 74. Once visual verification of the centering is complete, the lineman may then allow the lower end of the fuseholder 32 to come to rest upon inclined surfaces 70, still holding the fuse portion 32 by the hook stick until gravity causes the lower end of the fuse portion to slide down inclined surfaces 70 until trunnions 48 are properly seated within trunnion sockets 50. The lineman may then slide the hook stick up the fuse barrel 37 until it is engaged within indentation 82, again totally by feel, and rotate the fuseholder 32 upward until latching means 28 latches the top portion of the fuseholder 32, returning the assembly to the operative position. In the event that the fusible link 38 melts, the spring loaded latch 28 is forced down thereby disengaging the latch 28 and causing the downward rotation of the fuseholder 32. The fuseholder 32 may then be removed by positioning the operating end of a finger tool to engage arcuate pull tab 47 and then lifting the entire fuseholder 32 out. Once the fuse 38 has been replaced, the cutout 10 may be repositioned into the operative (closed) position as described above.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A cutout assembly comprising:

a fuseholder and an insulator connected in parallel by upper and lower contact assemblies, said fuseholder having an upper and a lower end, said upper contact assembly formed of a latching means and said lower contact assembly including trunnion sockets for receiving trunnions extending laterally from said lower end of said fuseholder in journaled relation, said trunnions including a first reflective alignment means positioned on at least a portion of exterior surfaces of said trunnions;

a slide member attached to said lower contact assembly, said slide member including a substantially funnel shaped inner surface, and a second reflective alignment means attached on opposing sides of said slide member.

2. The assembly of claim 1 including a pull ring extending from said upper end of said fuseholder, said pull ring including a pair of cooperating arcuate protrusions extending outwardly therefrom.

3. The assembly of claim 1 wherein an arcuate pull tab is attached to the lower end of said fuseholder.

4. The assembly of claim 1 wherein said slide member is made of a non-electrically conductive material.

5. The assembly of claim 1 wherein said slide member is made of a foam plastic material.

6. The assembly of claim 1 wherein said second reflective alignment means is formed of a rigid material and sized for frictional fit over said trunnions.

7. The assembly of claim 1 wherein said first reflective means is formed of a reflective material positioned on a substrate with adhesive backing.

8. A cutout assembly having a fuseholder and insulator electrically connected in parallel by upper and lower contact assemblies, said fuseholder adapted for rotation into and out of electrical connection with said insulator by engagement with an operating end of a hook stick, said cutout assembly comprising:

said fuseholder having an upper and a lower end, said upper contact assembly formed of a latching means and said lower contact assembly including trunnion sockets for receiving trunnions extending laterally from said lower end of said fuseholder in journaled relation, said trunnions including a first reflective alignment means positioned on at least a portion of exterior surfaces of said trunnions;

a slide member attached to said lower contact assembly, said slide member including a substantially funnel shaped inner surface, and a second reflective alignment means attached on opposing sides of said slide member;

a pull ring connected to and extending from said upper end of said fuseholder, said pull ring having an outer surface and including a pair of opposing arcuate protrusions extending outwardly therefrom, said protrusions forming upper and lower indentations along said outer surface which indentations are engageable with the operating end of said hook stick;

whereby said upper indentation is adapted to receive the operating end of said hook stick to arrest upward motion of said hook stick, and said lower indentation is adapted to receive the operating end of said hook stick to enable rotation of said fuseholder.

9. The assembly of claim 8 wherein said slide member is made of a non-electrically conductive material.

10. The assembly of claim 8 wherein said slide member is made of a foam plastic material.

11. The assembly of claim 1 wherein said second reflective alignment means is formed of a rigid material and sized for frictional fit over said trunnions.

12. The assembly of claim 1 wherein said first reflective alignment means is formed of a reflective material positioned on a substrate with adhesive backing.

* * * * *